US011396744B2

(12) United States Patent
Sato et al.

(10) Patent No.: US 11,396,744 B2
(45) Date of Patent: Jul. 26, 2022

(54) FLUSH TOILET

(71) Applicant: PANASONIC INTELLECTUAL PROPERTY MANAGEMENT CO., LTD., Osaka (JP)

(72) Inventors: Yasushi Sato, Osaka (JP); Masato Miyamoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 148 days.

(21) Appl. No.: 16/645,748

(22) PCT Filed: Oct. 24, 2018

(86) PCT No.: PCT/JP2018/039431
§ 371 (c)(1),
(2) Date: Mar. 9, 2020

(87) PCT Pub. No.: WO2019/097966
PCT Pub. Date: May 23, 2019

(65) Prior Publication Data

US 2020/0284013 A1 Sep. 10, 2020

(30) Foreign Application Priority Data

Nov. 15, 2017 (JP) ..... JP2017-220384
Feb. 23, 2018 (JP) ..... JP2018-031358

(51) Int. Cl.
*E03D 3/00* (2006.01)

(52) U.S. Cl.
CPC ..... *E03D 3/00* (2013.01)

(58) Field of Classification Search
CPC ..... E03D 3/00
(Continued)

(56) References Cited

U.S. PATENT DOCUMENTS 2,161,204 A 6/1939 Shanley
6,098,651 A 8/2000 Boticki et al.

FOREIGN PATENT DOCUMENTS

EP 2 757 204 A1 7/2014
FR 2 696 770 A1 4/1994
(Continued)

OTHER PUBLICATIONS

Extended European Search Report issued in European patent application No. 18 87 7487.1, dated Dec. 2, 2020.
(Continued)

*Primary Examiner* — Tuan N Nguyen
(74) *Attorney, Agent, or Firm* — Greenblum & Bernstein, P.L.C.

(57) ABSTRACT

A flush toilet includes: a bowl; at least one water discharge port to discharge water into the bowl; a water supply path to supply the water from a water supply source to the water discharge port therethrough; and a backflow check structure provided for the water supply path. The backflow check structure checks a backflow of the water running through the water supply path. The backflow check structure has: a water inlet port exposed to the air and directly communicating with the water discharge port; and a water outlet port to channel the water supplied from the water supply source toward the water inlet port. The water inlet port is arranged on a trajectory of the water running out through the water outlet port. The water that has passed through the water inlet port is channeled directly toward the water discharge port.

10 Claims, 8 Drawing Sheets

(58) Field of Classification Search
USPC ..... 4/420
See application file for complete search history.

(56) References Cited

FOREIGN PATENT DOCUMENTS

| | | |
|---|---|---|
| JP | 2001-279787 | 10/2001 |
| JP | 2004-225342 | 8/2004 |
| JP | 2004-301326 | 10/2004 |
| KR | 10-1592233 | 2/2016 |

OTHER PUBLICATIONS

Official Communication issued in International Bureau of WIPO Patent Application No. PCT/JP2018/039431, dated Dec. 18, 2018, along with an English translation thereof.

FLUSH TOILET

CROSS-REFERENCE TO RELATED APPLICATIONS

This application is a National Stage of International Application No. PCT/JP2018/039431 filed Oct. 24, 2018, claiming priority to Japanese Patent Application No. 2017-220384, filed Nov. 15, 2017, and Japanese Patent Application No. 2018-031358, filed Feb. 23, 2018, the contents of each application being incorporated herein by reference in its entirety.

TECHNICAL FIELD

The present invention generally relates to a flush toilet, and more particularly relates to a flush toilet having a structure for checking the backflow of water through a water supply path.

BACKGROUND ART

In a known flush toilet, a vacuum breaker is provided on a water supply path that connects a water discharge port for supplying water into a bowl to a water supply source (see, for example, Patent Literature 1). The vacuum breaker of Patent Literature 1 includes a water inlet port, a water outlet port, and an air inlet port. The vacuum breaker further includes a movable valve body for selectively allowing either the water inlet port and water outlet port, or the water outlet port and the air inlet port, to communicate with each other. The movable valve body moves while being guided along a guide shaft supported by a container to close either the water inlet port or the water outlet port by making tight contact with the valve seat at the peripheral edge of the water inlet or outlet port's opening.

Meanwhile, the water running through the water inlet port and the water outlet port sometimes contains minute dirt, dust, and other wastes (hereinafter referred to as "dirt and other wastes"), and therefore, the valve seat may sometimes collect such dirt and other wastes. If the movable valve body moves with the dirt and other wastes collected on the valve seat, then the dirt and other wastes may be trapped in the gap between the valve seat and the movable valve body, thus making the contact between the valve seat and the movable valve body insufficiently tight and eventually causing some failure.

CITATION LIST

Patent Literature

Patent Literature 1: JP 2004-301326 A

SUMMARY OF INVENTION

It is therefore an object of the present invention to provide a flush toilet with a backflow check structure that does not easily cause failures.

A flush toilet according to an aspect of the present invention includes: a bowl to receive excreta; at least one water discharge port to discharge water into the bowl; a water supply path to supply the water from a water supply source to the water discharge port therethrough; and a backflow check structure provided for the water supply path to check a backflow of the water running through the water supply path. The backflow check structure has a water inlet port and a water outlet port. The water inlet port is exposed to the air and directly communicates with the water discharge port. The water outlet port channels the water supplied from the water supply source toward the water inlet port. The water inlet port is arranged on a trajectory of the water running out through the water outlet port. The water that has passed through the water inlet port is channeled directly toward the water discharge port.

DESCRIPTION OF EMBODIMENTS

(1) Embodiment

Figure 1:
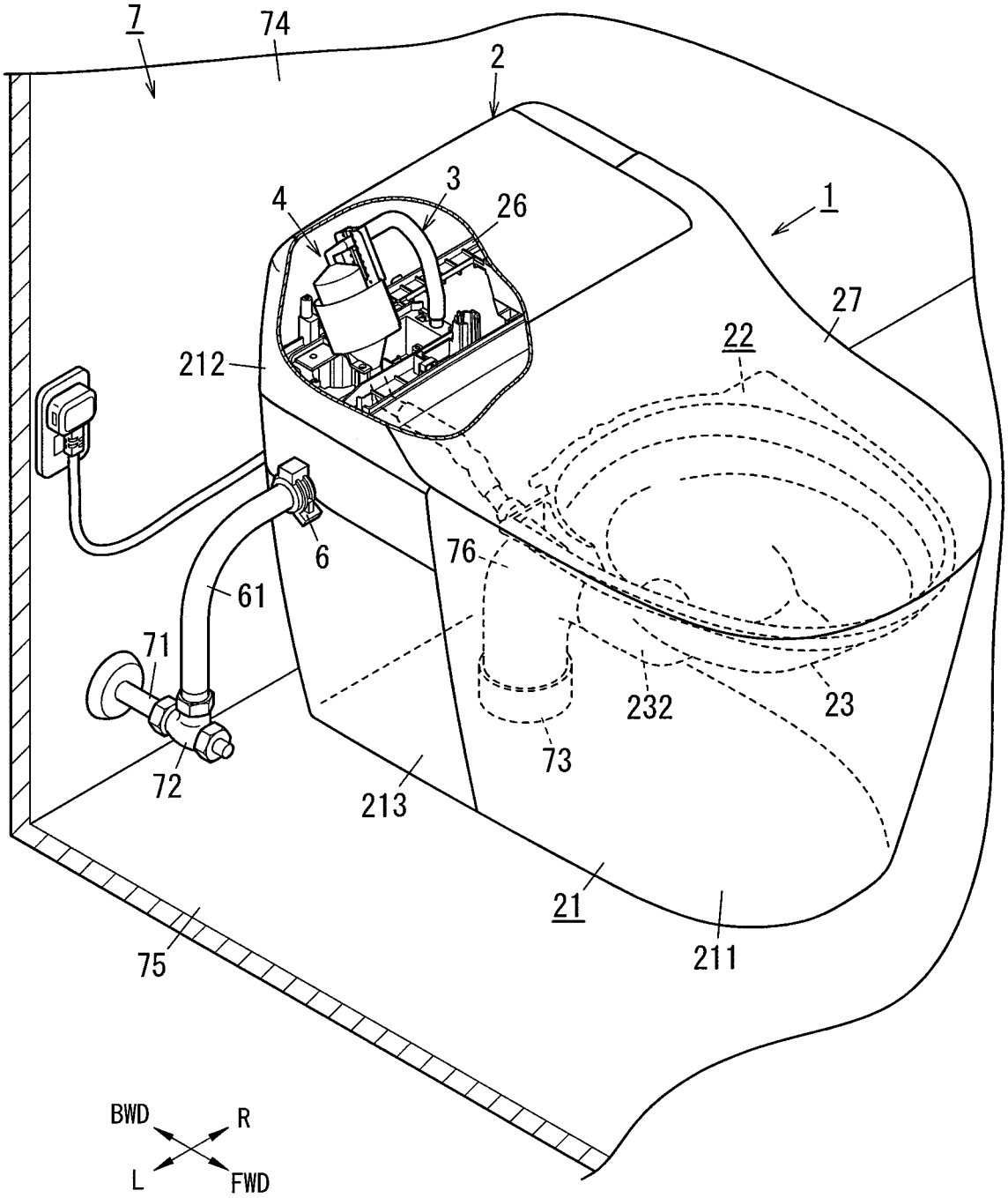
FIG. 1 is a perspective view of a flush toilet according to an exemplary embodiment of an aspect of the present invention.

A flush toilet 1 according to an exemplary embodiment is installed in a rest room 7 (or bath room) as shown in FIG. 1. The rear wall 74 of the rest room 7 is provided with a water supply pipe 71 as a water supply source and a water shut-off valve 72 is provided at one end of the water supply pipe 71. Also, the floor 75 of the rest room 7 is provided with a drainpipe 73. In this embodiment, when the flush toilet 1 is installed in the rest room 7, a connecting member 6 is connected to the water shut-off valve 72 via a pipe 61 and a drainpipe 232 of a bowl 23 is connected to the drainpipe 73 via a drain trap 76. Letting the water shut-off valve 72 communicate with the connecting member 6 allows the water to be supplied from the water supply source into the water supply path 3 of the flush toilet 1.

The water supply pipe 71 according to this embodiment is a pipe branched from a water distributing pipe, leading to a distributing reservoir, toward each dwelling house. Therefore, the water supplied from the water supply pipe 71 as a water supply source has a certain water pressure. Actually, however, the water pressure varies to a certain degree according to the congestion of houses in a given area or hours of the day when the flush toilet 1 is used. In this embodiment, the water supply source includes the water shut-off valve 72 provided at the downstream end of the water supply pipe 71.

According to the present disclosure, the water supply source does not have to be the water supply pipe 71 but may also be a water reservoir tank, for example. In that case, a pump may be installed in the rest room 7 to pump water from the tank using the pump. Alternatively, a tank may also be installed on the roof of a building so that water is channeled from the tank using potential energy. In short, the "water supply source" according to the present disclosure may be any type of source of the water to be supplied to the flush toilet 1, no matter whether or not the water supply source has water pressure or whether or not the water supply source has a pump.

The flush toilet 1 according to this embodiment includes a toilet body 2, the water supply path 3, a backflow check structure 4, and the connecting member 6. In FIG. 1, a direction pointing from the flush toilet 1 toward the rear wall 74 of the rest room 7 and aligned with a horizontal plane is defined herein as a "backward direction" and the opposite direction thereof is defined herein as a "forward direction." In addition, the rightward/leftward direction is defined with respect to a user who faces the flush toilet 1 from the front of the flush toilet 1 in the backward direction (see FIG. 1).

The toilet body 2 forms the principal body of the flush toilet 1. The toilet body 2 includes a plurality of outer parts 21, an inner part 22, a base 26, a toilet seat (not shown), and a toilet lid 27.

The plurality of outer parts 21 form the outer shell of the flush toilet 1. These outer parts 21 are mounted on a frame (not shown) to form the outer shell of the flush toilet 1. In this embodiment, the outer parts 21 include a skirt 211 supporting the inner part 22 thereon, a rear lower part 213 provided behind the skirt 211, and a rear upper part 212 located over the rear lower part 213. The toilet seat and the toilet lid 27 are mounted on the rear upper part 212 so as to be rotatable around a rightward/leftward axis. As used herein, the "rightward/leftward axis" refers herein to a rotational axis extending in the rightward/leftward direction, and may or may not have a shaft member.

Figure 2:
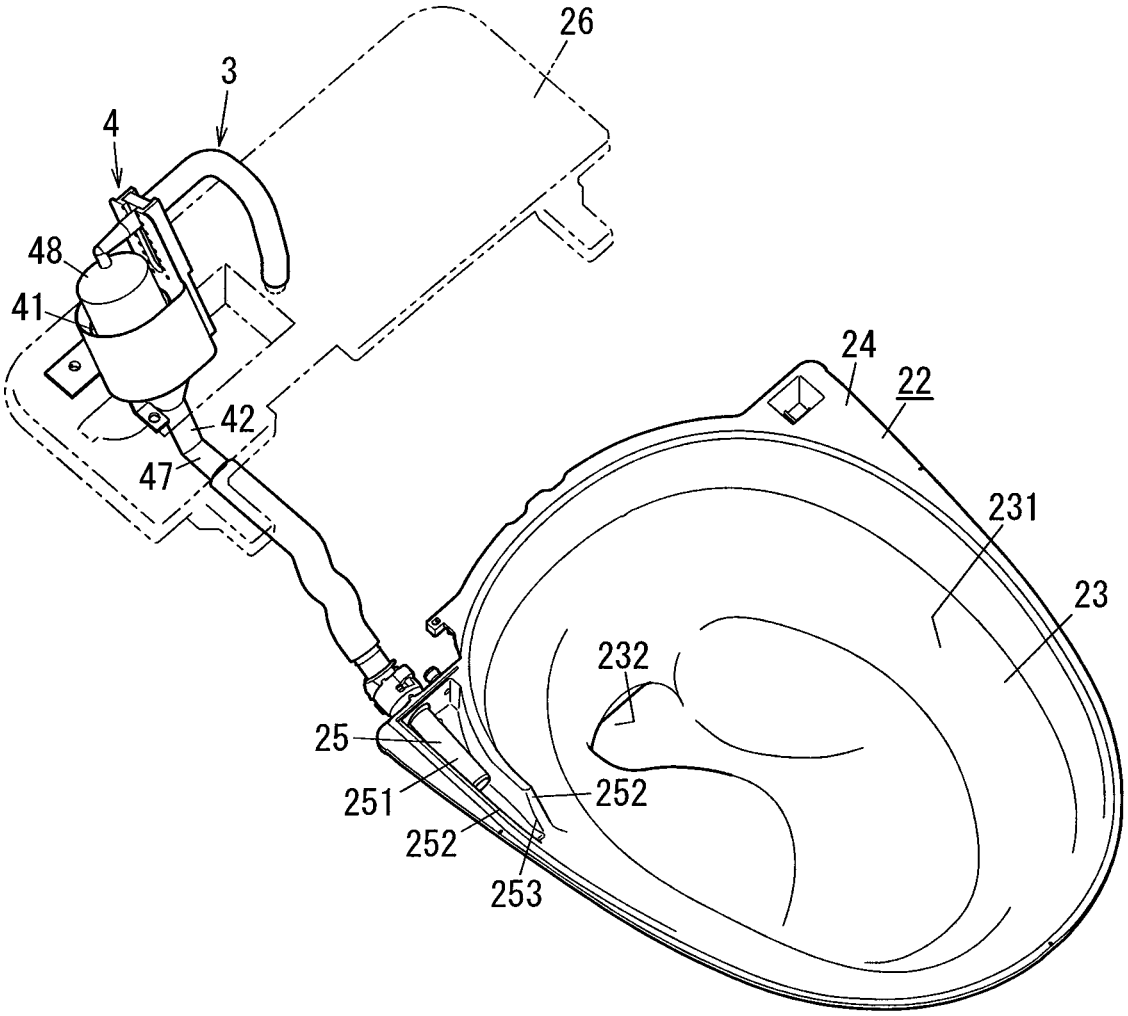
FIG. 2 is a perspective view illustrating a backflow check structure and a bowl of the flush toilet.

The inner part 22 is a part arranged inside a space surrounded with the outer parts 21 and the toilet lid 27. The inner part 22 is supported by an upper end portion of the skirt 211. The inner part 22 includes the bowl 23, a water discharge portion 25, and a supporting portion 24 as shown in FIG. 2.

The bowl 23 is a part to receive excreta (i.e., urine and feces) discharged by the user. The bowl 23 is formed in the shape of a cup, of which the upper end is an opening and the lower end includes the drainpipe 232. The inner surface of the bowl 23 (hereinafter referred to as a "bowl surface 231") is tilted downward toward the front end of the drainpipe 232. The water discharged from the water discharge portion 25 swirls around the vertical axis along the bowl surface 231. As shown in FIG. 1, the rear end of the drainpipe 232 is connected via the drain trap 76 to the drainpipe 73 leading to a sewer.

As used herein, if the water "swirls" on the bowl surface 231, it means that the water travels around the vertical axis along the inner surface of the bowl 23. Therefore, the "swirl" of the water may naturally refer to a situation where the water makes one or more rounds about the vertical axis but may also refer to a situation where the water makes less than one round about the vertical axis as well.

The drain trap 76 is provided to prevent unpleasant odor from flowing back from the drainpipe 73 toward the bowl 23 and also prevent sanitary insects, for example, from attempting to enter the bowl 23 from the drainpipe 73. The drain trap 76 may be implemented as a so-called "S-trap" which is an S-shaped pipe, or a movable trap, for example. The movable trap has its state switched by a motor, for example, from a state where the tip of its flexible pipe connected to the drainpipe 232 of the bowl 23 faces upward to a state where the tip of the flexible pipe faces downward, and vice versa. Optionally, the drain trap 76 may be replaced with an excreta tank including a pump. The excreta tank is connected to the drainpipe 232 and configured to drain excreta into the sewer using the pump.

The water discharge portion 25 is a portion for discharging water onto the inner surface of the bowl 23. The water discharge portion 25 is arranged adjacent to the opening of the bowl 23. The water discharge portion 25 includes a water discharge nozzle 251, a pair of standup walls 252, and a water discharge port 253.

The water discharge nozzle 251 is a nozzle for discharging the water supplied through the water supply path 3. The water discharge nozzle 251 is arranged between the pair of standup walls 252. The pair of standup walls 252 guides the water discharged from the water discharge nozzle 251 so that the water swirls along the bowl surface 231. The water discharge port 253 is a port through which the water is discharged onto the bowl 23. In this embodiment, the water discharge port 253 is an opening facing toward the bowl 23 and configured to supply, onto the bowl 23, the water that has been discharged from the water discharge nozzle 251 and guided by the pair of standup walls 252. In this embodiment, the water discharge port 253 is implemented as an opening formed by the end of the standup wall 252 located inside of the bowl 23 and a part of the opposing standup wall 252 located outside of the bowl 23, out of the pair of standup walls 252.

In this embodiment, the water discharge port 253 is formed by the end of the standup wall 252 and a part of the opposing standup wall 252. However, this is only an example and should not be construed as limiting. Alternatively, if the water discharge nozzle 251 faces the bowl surface 231, then the opening at the tip of the water discharge nozzle 251 may be the water discharge port 253. Also, the number of the water discharge port 253 provided does not have to be one. Alternatively, the single water discharge nozzle 251 may be configured to have a plurality of openings. Still alternatively, the water supply path 3 may be branched halfway and the water discharge nozzle 251 may be provided for each of the downstream end of the water supply path 3 and the downstream end of the branch path. Optionally, the opening may be configured as a hole. That is to say, as used herein, the "water discharge port 253" refers to a type of opening for discharging the water directly onto the bowl surface 231. The flush toilet 1 according to the present disclosure may include at least one water discharge port 253.

The supporting portion 24 is a portion extended outward from the outer edge of the surface surrounding the opening of the bowl 23 and supported by the upper end portion of the skirt 211. The bowl 23 and the water discharge portion 25 are fixed via the supporting portion 24 onto the outer parts 21. As used herein, the "upper end portion of the skirt 211" refers to a portion, covering a certain range from the top through a point lower than the top by a certain dimension, of the skirt 211.

The base 26 is a part for mounting the backflow check structure 4 (to be described in detail later) onto an inner space of the rear upper part 212. The base 26 is arranged inside the rear upper part 212.

The water supply path 3 is a passage through which the water supplied from the water supply source is channeled toward the water discharge portion 25. The upstream end of the water supply path 3 is connected to the connecting member 6, while the downstream end of the water supply path 3 is connected to the water discharge nozzle 251. The water supply path 3 is provided with a water supply valve (not shown). When the water supply valve opens, the water in the water supply path 3 starts running. When the water supply valve is closed, the water in the water supply path 3 stops running. In addition, in this embodiment, the water supply path 3 is provided with a constant flow valve (not shown) so that water flows at a constant flow rate. Thus, even if the water pressure of the water supplied from the water supply source varies to a certain degree, the water is discharged at a constant flow rate through the water discharge port 253 into the bowl 23.

The water supply path 3 is provided with the backflow check structure 4. The backflow check structure 4 checks the backflow of the water running through the water supply path 3. This reduces, even if damage is done to the water supply path 3 when the level of the water run up in the bowl 23 rises so much as to immerse the water discharge portion 25 in the water that has run up, the chances of the water run up in the bowl 23 flowing back through the water supply path 3.

Figure 3:
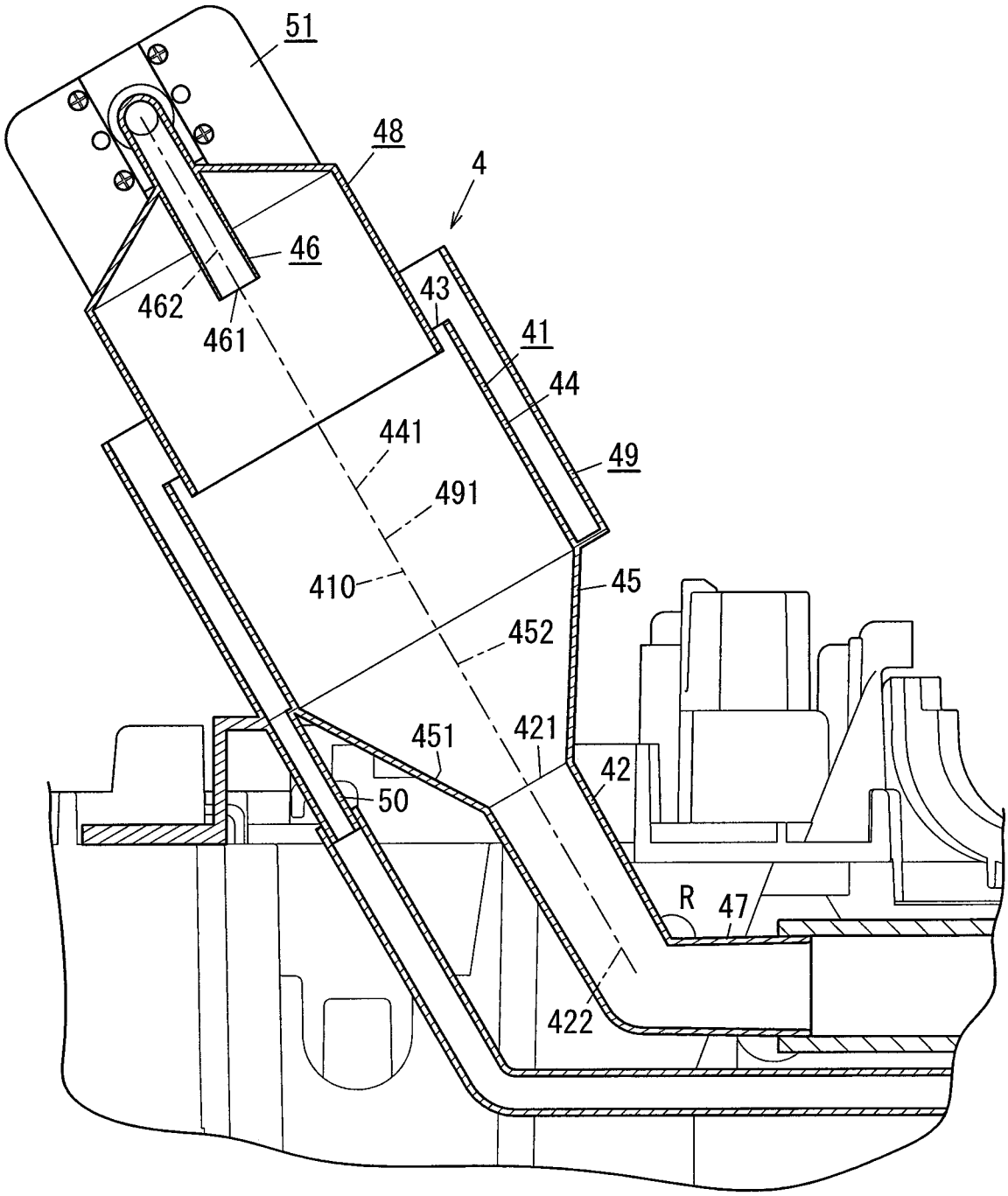
FIG. 3 is a cross-sectional view of the backflow check structure and its surrounding portions taken along a vertical plane.

FIG. 3 illustrates a cross section of the backflow check structure 4 and its surrounding portions taken along a vertical plane. As shown in FIG. 3, the backflow check structure 4 includes a water reservoir 41, a water outlet pipe 46, a splash reducing jacket 48, a receiving vessel 49, and a holder 51.

The water reservoir 41 is a funnel with an opening exposed to the air (such an opening will be hereinafter referred to as an "air opening 43"), which is able to receive and run up a certain amount of water. At least part (e.g., all in this embodiment) of the water reservoir 41 is located above the upper end of the bowl 23. The water reservoir 41 includes a cylindrical peripheral wall 44, a bottom wall 45 formed at the lower end of the peripheral wall 44, a water inlet pipe 42 provided for the bottom wall 45, and a connecting pipe 47 connected to the lower end of the water inlet pipe 42.

The peripheral wall 44 defines the outer wall of the water reservoir 41. The peripheral wall 44 is formed in a cylindrical shape. The center axis 441 of the peripheral wall 44 is tilted with respect to a horizontal plane. As used herein, the "horizontal plane" refers to a plane that is parallel to the upper surface of the floor 75 (i.e., the floor surface) of the rest room 7. In other words, the "horizontal plane" refers herein to a plane that is parallel to the plane including the lower end surface of the skirt 211 of the flush toilet 1.

The bottom wall 45 defines the lower wall of the water reservoir 41 and is connected to the lower end of the peripheral wall 44. The bottom wall 45 is formed in the shape of a truncated cone cylinder (i.e., a tapered shape). The center axis 452 of the bottom wall 45 is located on the extension of the center axis 441 of the peripheral wall 44. That is to say, the center axis 452 of the bottom wall 45 is tilted with respect to the horizontal plane. The water inlet pipe 42 is connected to the bottom wall 45. The center axis 422 of the water inlet pipe 42 is also located on the extension of the center axis 441 of the peripheral wall 44 and the center axis 452 of the bottom wall 45 (which will be hereinafter collectively referred to as the "center axis 410 of the water reservoir 41"). The upper surface of the bottom wall 45 (i.e., the inner surface, facing the water reservoir 41, of the bottom wall 45 along the thickness thereof) defines a water guide surface 451 tilted downward toward the water inlet pipe 42.

The water inlet pipe 42 is connected to the bottom wall 45. The water inlet pipe 42 has a water inlet port 421 and communicates with the water reservoir 41 via the water inlet port 421. The water inlet port 421 is an opening located at the upper longitudinal end of the water inlet pipe 42 and faces the internal space of the water reservoir 41. In addition, the water inlet port 421 communicates directly with the water discharge port 253. For example, in the example illustrated in FIG. 2, the connecting pipe 47 of the water reservoir 41 is connected to the water discharge portion 25 via only a pipe having no ports between both ends thereof (e.g., a flexible pipe). The surface surrounding the opening of the water inlet port 421 is a plane, which is tilted with respect to a vertical line and intersects at right angles with the center axis 410 of the water reservoir 41. In this embodiment, the water inlet pipe 42 is implemented as a cylindrical pipe and the center axis 422 of the water inlet pipe 42 is tilted with respect to the horizontal plane. The center axis 422 of the water inlet pipe 42 is located on the extension of the center axis 410 of the water reservoir 41. As used herein, the "vertical line" is a line perpendicular to the horizontal plane. Also, the center axis 422 of the water inlet pipe 42 passes through the center of the water inlet port 421. In this embodiment, the surface surrounding the opening of the water inlet port 421 intersects with the center axis 422 at right angles. However, this is only an example and should not be construed as limiting. Alternatively, according to the present disclosure, the surface surrounding the opening of the water inlet port 421 may be tilted with respect to the center axis 422.

Also, as used herein, if something "communicates directly with" something else, it means that the former and the latter communicate with each other without being exposed to the air. In this embodiment, the water inlet port 421 communicates with the water discharge port 253 via a pipe (or a tube) and no intermediate member such as a tank, for example, is provided between the water inlet port 421 and the water discharge port 253.

The connecting pipe 47 is a portion, to which a pipe such as a tube for connecting the water discharge nozzle 251 to the water inlet pipe 42 is attached. The connecting pipe 47 is tilted with respect to the water inlet pipe 42, and extends horizontally. The angle R formed between the connecting pipe 47 and the water inlet pipe 42 is an obtuse angle.

Over the water reservoir 41 with such a configuration, provided is a water outlet pipe 46 for pouring the water toward the water reservoir 41. The water is supplied from the water supply source into the water outlet pipe 46. The water outlet pipe 46 has a water outlet port 461, through which the water supplied from the water supply source is poured into the water reservoir 41. The water outlet pipe 46 has a center axis 462, which passes through the center of the water outlet port 461.

The water outlet port 461 is an opening at the lower end of the water outlet pipe 46. The water running out through the water outlet port 461 passes through the space, which is exposed to the air, inside the backflow check structure 4. The surface surrounding the opening of the water outlet port 461 is a plane, which is tilted with respect to a vertical line. Also, in this embodiment, the surface surrounding the opening of the water outlet port 461 intersects at right angles with the center axis 410 of the water reservoir 41. The center of the water inlet port 421 is located on the extension of the center axis 462 passing through the center of the water outlet port 461. Also, the center axis 462 is tilted with respect to the vertical line. Furthermore, in this embodiment, the surface surrounding the opening of the water outlet port 461 is parallel to the surface surrounding the opening of the water inlet port 421. In this embodiment, the surface surrounding the opening of the water outlet port 461 intersects at right angles with the center axis 462. However, this is only an example and should not be construed as limiting. Alternatively, according to the present disclosure, the surface surrounding the opening of the water outlet port 461 may be tilted with respect to the center axis 462.

Thus, according to this embodiment, the water inlet port 421 is arranged on the trajectory of the water running out through the water outlet port 461. Thus, the water running out through the water outlet port 461 directly enters the water inlet port 421. As used herein, if the water running out through the water outlet port 461 "directly enters the water inlet port 421," then it means that at least part (suitably most) of the water running out through the water outlet port 461 enters the water inlet port 421 without being guided into a groove, a pipe, a gutter, or any other guide member.

Therefore, the water running out through the water outlet port 461 enters the water inlet port 421 while substantially maintaining its initial velocity when the water left the water outlet port 461, and then runs out through the water discharge port 253 while maintaining the impetus to a certain extent. This allows the flush toilet 1 according to this embodiment to discharge the water through the water discharge port 253 onto the bowl surface 231 while adequately maintaining the pressure of the water as supplied from the water supply source, even though the water is exposed to the air in the water reservoir 41. As a result, a swirl flow may be formed on the bowl surface 231.

The diameter of the water outlet port 461 is equal to or less than the diameter of the water inlet port 421. In this embodiment, the diameter of the water outlet port 461 is suitably within the range from 30% to 100%, and more suitably within the range from 40% to 50%, of the diameter of the water inlet port 421.

This allows the water running out through the water outlet port 461 to enter the water inlet port 421 more easily. In this embodiment, the surface surrounding the opening of the water outlet port 461 is tilted with respect to the vertical line, and therefore, the trajectory of the water running out through the water outlet port 461 draws a part of a parabola. However, since the diameter of the water outlet port 461 is restricted to the diameter of the water inlet port 421 or less, the water inlet port 421 is able to effectively receive the water running out through the water outlet port 461.

The holder 51 holds the water outlet pipe 46 with respect to the water reservoir 41. The holder 51 may hold the water outlet port 461 such that the water outlet port 461 is movable in a direction perpendicular to the surface surrounding the opening of the water inlet port 421. This allows adjustments to be made such that the water running out through the water outlet port 461 enters the water inlet port 421 more effectively.

The backflow check structure 4 further includes the splash reducing jacket 48. The splash reducing jacket 48 is a jacket with the ability to receive the water splashing toward the air opening 43 of the water reservoir 41. The splash reducing jacket 48 is configured to channel the received water into the water reservoir 41. Specifically, the splash reducing jacket 48 according to this embodiment is formed in the shape of cylinder with a top plate, and the lower end of the splash reducing jacket 48 is arranged inside the peripheral wall 44 of the water reservoir 41. The backflow check structure 4 maintains the state of leaving a certain gap between the lower end of the splash reducing jacket 48 and the peripheral wall 44 of the water reservoir 41 and opening the gap to the air.

The splash reducing jacket 48 covers most of the air opening 43 of the water reservoir 41. The splash reducing jacket 48 is fixed to the water outlet pipe 46 and configured to be movable along the center axis 410 of the water reservoir 41. This makes the width of the gap between the splash reducing jacket 48 and the peripheral wall 44 of the water reservoir 41 adjustable.

In this embodiment, the lower end of the splash reducing jacket 48 is located, in the direction aligned with the center axis 410 of the water reservoir 41, under the upper end of the water reservoir 41. However, this is only an example and should not be construed as limiting. Alternatively, the lower end of the splash reducing jacket 48 may be located, in the direction aligned with the center axis 410 of the water reservoir 41, over the upper end of the water reservoir 41. That is to say, the splash reducing jacket 48 according to the present disclosure only needs to receive the water that has splashed by colliding against the inner surface of the water reservoir 41 or the water that has splashed directly from the water outlet pipe 46.

The receiving vessel 49 surrounds the outer periphery of the water reservoir 41. The receiving vessel 49 is formed in the shape of a bottomed cylinder, and is fixed to the water reservoir 41 such that its center axis 491 is aligned with the center axis 410 of the water reservoir 41 as shown in FIG. 3. The receiving vessel 49 is a vessel for receiving the water overflowing from the water reservoir 41. The upper end surface of the receiving vessel 49 is located, in the direction defined by the center axis 410 of the water reservoir 41, over the upper end surface of the water reservoir 41.

An overflow pipe 50 is connected to the receiving vessel 49. The overflow pipe 50 is connected to the bottom of the receiving vessel 49 to channel the water received at the receiving vessel 49 into the bowl 23. The overflow pipe 50 is connected to the lowest portion (i.e., a portion located at the lowest level vertically) of the receiving vessel 49. Thus, even when the level of the water run up in the bowl 23 rises so much as to immerse the water discharge portion 25 in the water that has run up and cause the water to flow backward into the water inlet pipe 42, the water will flow back, through the gap between the lower end of the splash reducing jacket 48 and the peripheral wall 44 of the water reservoir 41, into the receiving vessel 49. Then, the water running into the receiving vessel 49 will be drained through the overflow pipe 50. This reduces the chances of the water that has run up in the bowl 23 flowing backward into the water outlet pipe 46.

The flush toilet 1 with such a configuration includes the connecting member 6 for connecting the water supply source to the water supply path 3 as shown in FIG. 1. The connecting member 6 is provided to be exposed on the outer parts 21 of the flush toilet 1. In this embodiment, the connecting member 6 is a joint for connecting the pipe 61. In this embodiment, the connecting member 6 is connected to the water shut-off valve 72 via a hose as the pipe 61. The water that has passed through the connecting member 6 is channeled directly (i.e., via no intermediate members such as tanks) into the water outlet pipe 46 while maintaining its water pressure. As used herein, if "the water that has passed through the connecting member 6 is channeled directly through the water supply path 3," then it means that the water that has passed through the connecting member 6 is channeled into the water outlet pipe 46 while maintaining its water pressure. In this embodiment, the water supply source has a water pressure, and therefore, the water maintaining the water pressure of the water supply source is channeled through the water supply path 3 into the water outlet pipe 46. As used herein, the phrase "maintaining the water pressure" may also be applied to a situation where the water pressure varies slightly due to a wall resistance or any other factor.

Therefore, the phrase "maintaining the water pressure" is also applicable to a water pressure that has varied by a matter of few percent.

As can be seen from the foregoing description, in the flush toilet 1 according to this embodiment, the backflow check structure 4 has a part exposed to the air but includes no driving mechanism such as a movable valve body. This reduces the chances of the flush toilet 1 according to this embodiment causing failures.

(2) Variations

Note that the embodiment described above is only an exemplary one of various embodiments of the present disclosure and should not be construed as limiting. Rather, the exemplary embodiment may be readily modified in various manners depending on a design choice or any other factor without departing from a true spirit and scope of the present disclosure.

Next, variations of the exemplary embodiment described above will be enumerated one after another.

(2.1) First Variation of Backflow Check Structure

Figure 4:
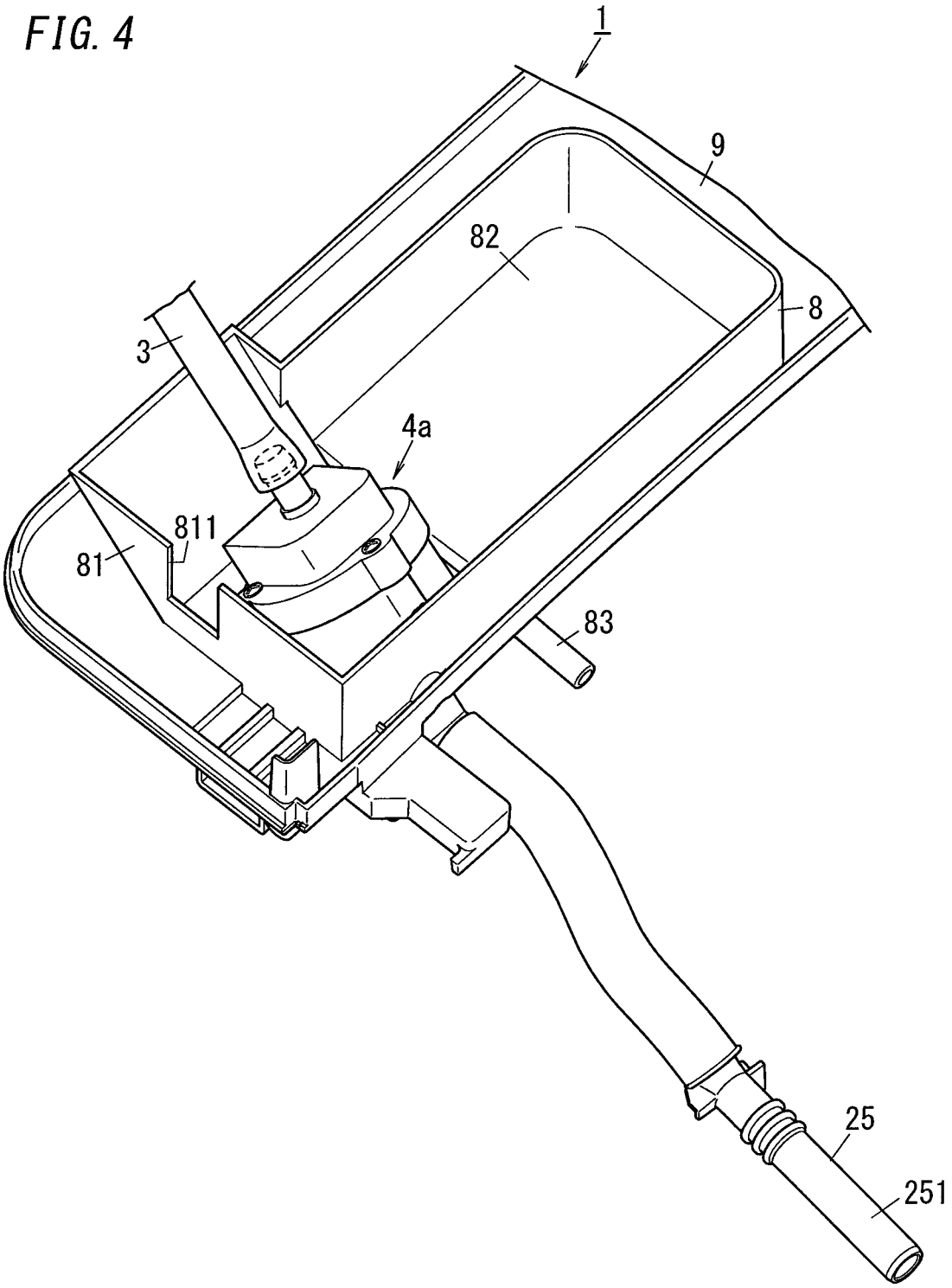
FIG. 4 is a perspective view illustrating a backflow check structure and bowl according to a first variation.
Figure 5:
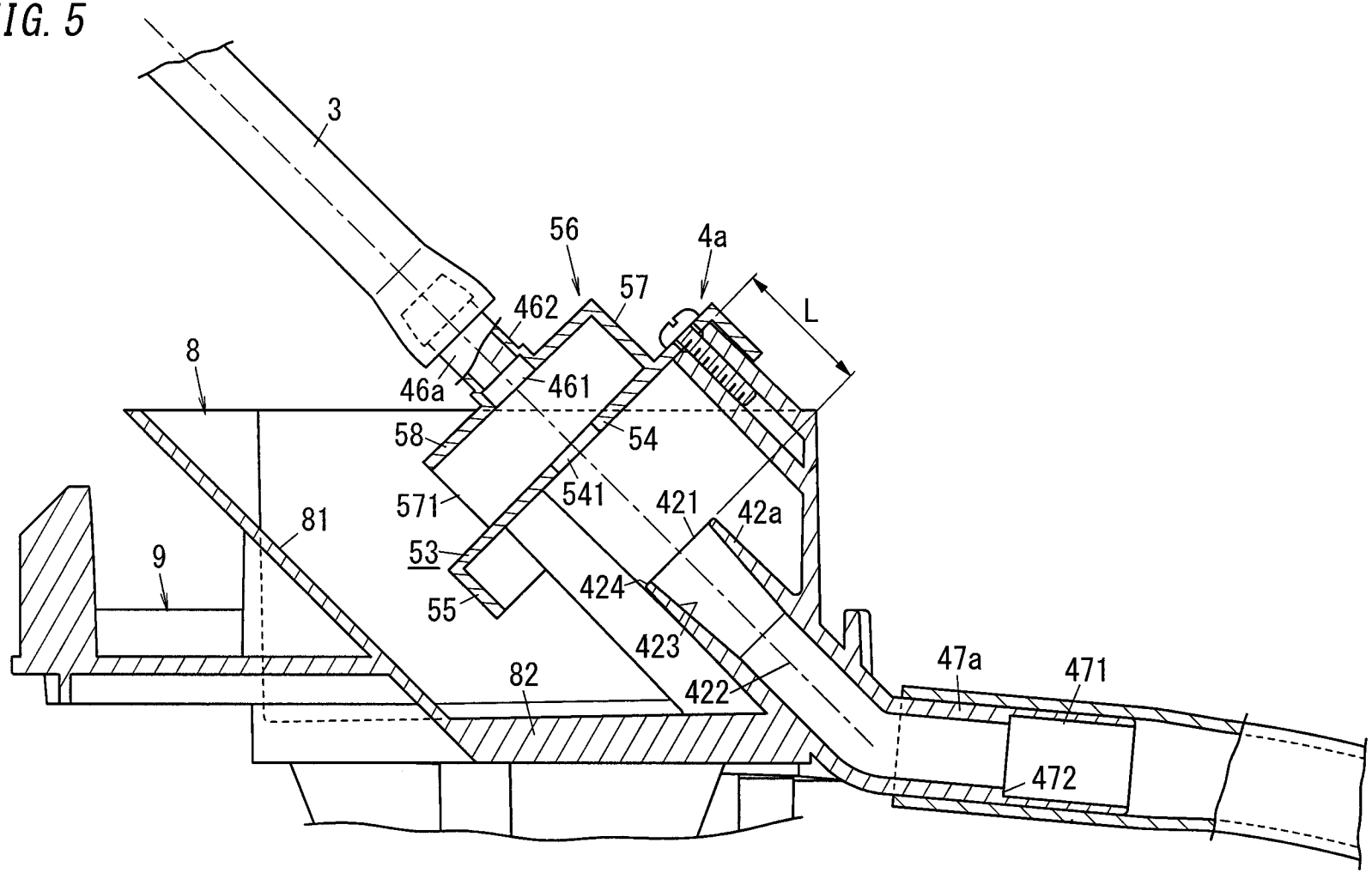
FIG. 5 is a cross-sectional view of the backflow check structure and its surrounding portions taken along a vertical plane.
Figure 6:
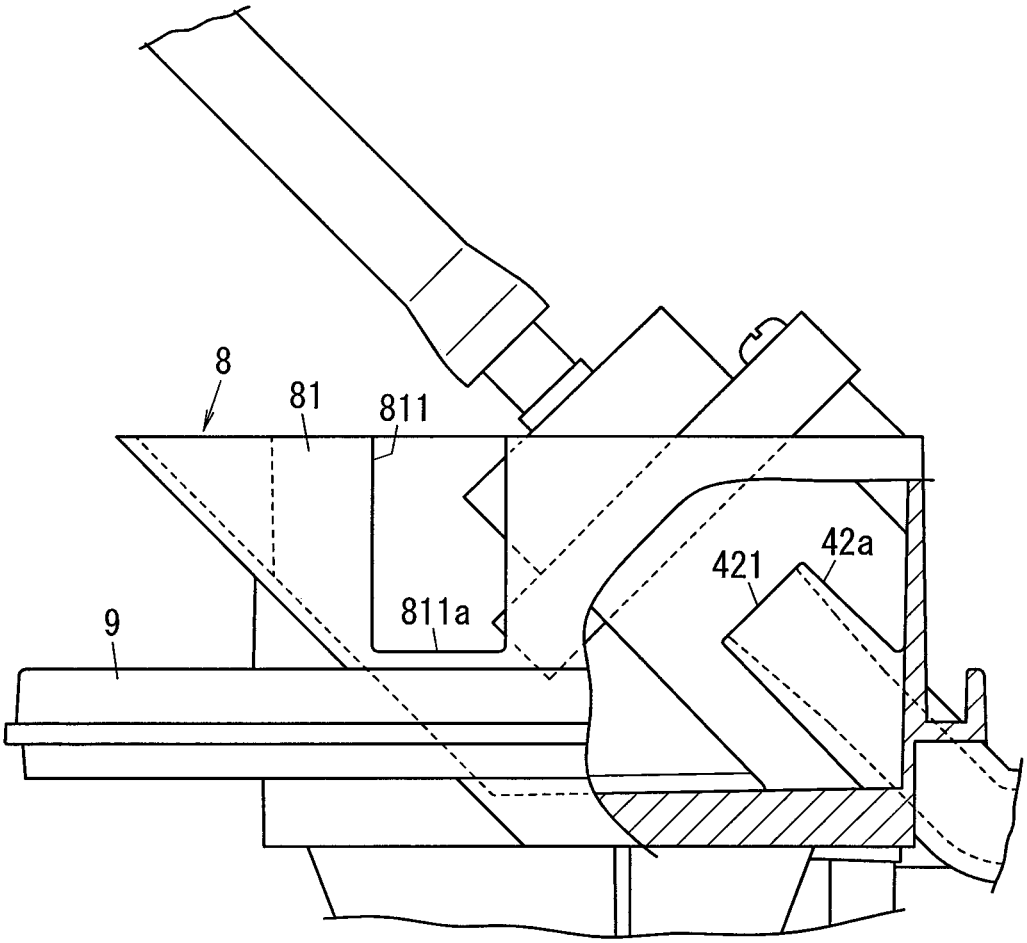
FIG. 6 is a side view of the backflow check structure and its surrounding portions.

A first variation of the backflow check structure 4*a* is illustrated in FIGS. 4 to 6. In the following description, any constituent element of this first variation, having the same function as a counterpart of the embodiment described above, will be designated by the same reference numeral as that counterpart's, and description thereof will be omitted herein. Note that the constituent elements, other than the ones to be described below, of the flush toilet 1 according to the first variation are the same as their counterparts of the flush toilet 1 according to the first embodiment described above.

The flush toilet 1 according to the first variation includes the backflow check structure 4*a* provided for the water supply path 3, a water receiver 8, and a drained water receiver 9 as shown in FIG. 4. In this variation, the drained water receiver 9 is provided in place of the base 26 according to the first embodiment (see FIG. 1).

The backflow check structure 4*a* checks the backflow of the water running through the water supply path 3. The backflow check structure 4*a* is provided for the water supply path 3. Having the backflow of the water through the water supply path 3 checked by the backflow check structure 4*a* reduces, even if damage is done to a part of the water supply path 3, the chances of the water that has run up in the bowl 23 (see FIG. 1) flowing backward through the water supply path 3 as in the exemplary embodiment described above. In this first variation, the backflow check structure 4*a* includes a water outlet pipe 46*a*, a water inlet pipe 42*a*, a connecting pipe 47*a*, a splash reducing portion 53, and a pipe supporting portion 56 as shown in FIG. 5.

The water outlet pipe 46*a* is a pipe for discharging the water supplied from the water supply source toward the water inlet pipe 42*a*. The water outlet pipe 46*a* has a water outlet port 461 at the downstream end face thereof. The water outlet port 461 is an opening through which the water running through the water outlet pipe 46*a* runs out. The water that has run out through the water outlet port 461 passes through the space, exposed to the air, inside the backflow check structure 4*a*. In short, the water outlet port 461 lets the water that has been supplied from the water supply source run out toward the water inlet port 421. In this variation, the water outlet pipe 46*a* is provided for the pipe supporting portion 56. Also, in this variation, the center axis 462 of the water outlet pipe 46*a* is tilted with respect to the horizontal plane.

The pipe supporting portion 56 supports the water outlet pipe 46*a*. In this variation, the pipe supporting portion 56 is provided for the splash reducing portion 53, and is mounted to the water receiver 8 via the splash reducing portion 53. Therefore, the pipe supporting portion 56 is fixed to the water receiver 8. The pipe supporting portion 56 includes a standup plate 57 and a supporting plate 58.

The standup plate 57 protrudes, in the direction aligned with the center axis 462 of the water outlet pipe 46*a*, from the splash reducing portion 53 toward an upstream end. The standup plate 57 creates a gap between the splash reducing portion 53 and the water outlet port 461. When viewed along the center axis 462 of the water outlet pipe 46*a*, the standup plate 57 is formed in a U-shape. In this variation, the standup plate 57 has an opening 571 through its lowest surface.

The supporting plate 58 is a plate provided with the water outlet pipe 46*a*, and is provided at the top of the standup plate 57. In this variation, the supporting plate 58 is a flat plate that intersects at right angles with the center axis 462 of the water outlet pipe 46*a*. The supporting plate 58 has a through hole, to which the water outlet pipe 46*a* is connected to communicate with the through hole. This makes, according to this variation, the lower surface of the supporting plate 58 level with the surface surrounding the opening of the water outlet port 461.

The splash reducing portion 53 reduces, when the water running out through the water outlet port 461 enters the water inlet port 421, the chances of the water splashing from the water inlet port 421 reaching the water outlet port 461. If the water running inside the water inlet pipe 42*a* has a high pressure when the water running out through the water outlet port 461 enters the water inlet port 421, then the water may flow backward from the water inlet port 421 or plash back from a pool of water on the water inlet port 421, thereby splashing the water in some cases. Thus, according to this variation, the splash reducing portion 53 is provided to prevent the splashing water from reaching the water outlet port 461. The splash reducing portion 53 is able to shut off the water that has splashed from the water inlet port 421. In this variation, the splash reducing portion 53 includes a water shutoff plate 54 and a pending piece 55.

The water shutoff plate 54 shuts off the water that has splashed from the water inlet port 421. In this variation, the water shutoff plate 54 is a flat plate. According to the present disclosure, however, the water shutoff plate 54 does not have to be a flat plate. The water shutoff plate 54 includes at least one surface facing the water inlet port 421. The one surface facing the water inlet port 421 is located at a certain distance, to say the least, from the water inlet port 421. In this variation, the distance L from the one surface facing the water inlet port 421 to the water inlet port 421 suitably falls within the range from 15 mm to 30 mm, and more suitably falls within the range from 20 mm to 25 mm.

In this variation, the water shutoff plate 54 is perpendicular to the center axis 462 of the water outlet pipe 46*a*, i.e., tilted with respect to the vertical axis. The water shutoff plate 54 is arranged between the water outlet port 461 and water inlet port 421. The water shutoff plate 54 has a water passage port 541. The water passage port 541 is located on the trajectory of the water running out through the water outlet port 461. This allows the water running out through the water outlet port 461 to pass through the water passage port 541.

In this variation, the diameter of the water passage port 541 is equal to or greater than the diameter of the water outlet port 461 and equal to or less than the diameter of the water inlet port 421. Specifically, the diameter of the water passage port 541 is greater than the diameter of the water outlet port 461 by a predetermined dimension (e.g., about 2 mm in this variation). According to this variation, setting the diameter of the water passage port 541 at a value equal to or greater than the diameter of the water outlet port 461 facilitates the passage, through the water passage port 541, of the water running out through the water outlet port 461. On the other hand, setting the diameter of the water passage port 541 at a value equal to or less than the diameter of the water inlet port 421 reduces the chances of the water that has splashed from the water inlet port 421 entering the water passage port 541. Furthermore, tilting the water shutoff plate 54 with respect to the vertical axis reduces the chances of the pool of the water formed on the water shutoff plate 54 remaining on the water shutoff plate 54.

The pending piece 55 protrudes, in the direction aligned with the center axis 462 of the water outlet pipe 46*a* (i.e., along the trajectory of the water), from the outer periphery of the water shutoff plate 54 toward a downstream end. That is to say, in this variation, the pending piece 55 is perpendicular to the water shutoff plate 54.

The water inlet pipe 42*a* receives the water running out through the water outlet port 461 and channels the water toward the bowl 23. The water inlet pipe 42*a* has the water inlet port 421 at the upstream end face thereof. The water inlet port 421 communicates with the water discharge port 253 (see FIG. 2), through which the water is discharged into the bowl 23. In this variation, the center axis 422 of the water inlet pipe 42*a* is located on the extension of the center axis 462 of the water outlet pipe 46*a*. In short, in this variation, the water inlet port 421 is also arranged on the trajectory of the water running out through the water outlet port 461 as in the embodiment described above.

The water inlet pipe 42*a* has an open end face around the water inlet port 421. This open end face is parallel to the surface surrounding the opening of the water inlet port 421. In other words, the open end face intersects at right angles with the center axis 422 of the water inlet pipe 42*a*. The open end face is tilted with respect to the vertical axis. In this embodiment, the open end face is a tilted surface 424. Any pool of water formed on the tilted surface 424 may flow along the tilted surface 424.

In this variation, the tilted surface 424 is the end face of the water inlet pipe 42*a*. According to the present disclosure, however, the tilted surface 424 may be formed, around the water inlet port 421, as a surface broader than the end face of the water inlet pipe 42*a*. In addition, according to the present disclosure, the tilted surface 424 may also be tilted with respect to the surface surrounding the opening of the water inlet port 421.

The water inlet pipe 42*a* includes a diameter decreasing portion 423 at the upstream end thereof. The diameter decreasing portion 423 is a portion, of which the diameter decreases from the water inlet port 421 toward a downstream end. In this variation, the diameter decreasing portion 423 is formed in a tapered shape. The diameter decreasing portion 423 is formed, along the center axis 422 of the water inlet pipe 42*a*, to cover a predetermined range from the water inlet port 421 toward the downstream end. The diameter decreasing portion 423 is formed at the upstream end of the water inlet pipe 42*a*. In short, in this variation, the diameter decreasing portion 423 is provided for the water supply path 3.

As described above, when the water runs out through the water outlet port 461 in a situation where the pressure of the water inside the water inlet pipe 42*a* has risen, the water may splash from the water inlet port 421 toward the water outlet port 461. In this variation, however, providing the diameter decreasing portion 423 increases the chances of the water splashing while broadening its range along the taper. Thus, as the splashing water goes more distant from the water inlet port 421, the water broadens its diameter and is more and more likely to splash away from the water outlet port 461. This reduces the chances of the splashed water reaching the water outlet port 461. Furthermore, according to this variation, the water shutoff plate 54 is provided between the water outlet port 461 and the water inlet port 421, thus reducing the chances the splashed water passing through the water passage port 541 to reach the water outlet port 461.

The connecting pipe 47*a* is a portion to which attached is a pipe such as tube that connects the water discharge portion 25 (see FIG. 4) and the water inlet pipe 42*a* together. The connecting pipe 47*a* is mostly the same as the counterpart of the embodiment described above. In this variation, however, the connecting pipe 47*a* has an expanded portion 471, which is a major difference from the embodiment described above.

The expanded portion 471 is a portion, of which the channel cross section expands toward a downstream end between the water inlet port 421 and the water discharge port 253. In other words, the channel cross section of the expanded portion 471 is larger by a predetermined dimension than the channel cross section of a portion upstream of the expanded portion 471. In this variation, the channel cross section is increased by providing a step 472, of which the surface is perpendicular to the direction aligned with the channel. However, this is only an example and should not be construed as limiting. Alternatively, according to the present disclosure, the expanded portion 471 may also be formed in a tapered shape such that its channel cross section expands continuously toward a downstream end.

According to this variation, the expanded portion 471 provided for the water supply path 3 checks the back flow even when the pressure of the water inside the water inlet pipe 42*a* rises due to stagnation of the water flow, for example. In particular, according to this variation, the expanded portion 471 is formed as the step 472, thus even more effectively checking the backflow at any point downstream of the expanded portion 471 inside the water supply path 3.

The backflow check structure 4*a* with such a configuration is fixed to the water receiver 8. As shown in FIG. 4, the water receiver 8 includes a peripheral wall 81 and a bottom wall 82. In this variation, in a plan view, the backflow check structure 4*a* is surrounded with the peripheral wall 81 and is able to receive the water running along the splash reducing portion 53 and the water running on the end face (tilted surface 424) of the water inlet pipe 42*a*. According to the present disclosure, however, the backflow check structure 4*a* does not have to be surrounded with the peripheral wall 81 or the bottom wall 82, but only needs to receive the water running along the splash reducing portion 53 and the water running on the tilted surface 424. As used herein, the phrase "in a plan view" means viewing some structure from over the upper surface thereof.

The peripheral wall 81 has an overflow opening 811. The overflow opening 811 is able to keep the level of the water run up in the water receiver 8 a constant level or less. In this variation, the overflow opening 811 is implemented as a rectangular cutout (which may also be a square cutout). Alternatively, according to the present disclosure, the overflow opening 811 may also be a hole cut through a middle of the height of the peripheral wall 81. That is to say, the overflow opening 811 does not have to be a cutout.

As shown in FIG. 6, the overflow opening 811 has a straight lower end 811*a*, which is parallel to the horizontal plane. The lower end 811*a* of the overflow opening 811 is located below the lower end of the water inlet port 421. Therefore, in this variation, the surface of the water run up in the water receiver 8 is located at a lower level than the water inlet port 421, thus reducing the chances of the water flowing out of the water receiver 8 into the water inlet port 421.

In this variation, the lower end 811*a* of the overflow opening 811 has a straight shape. According to the present disclosure, however, the lower end 811*a* may also have a V- or U-shape.

At least one drain (not shown) is connected to the water receiver 8. The water running through the drain is supplied to the bowl 23. The drain is formed by connecting a pipe such as a tube to a drainage fitting 83 connected to the water receiver 8 as shown in FIG. 4. The water that has leaked from the water inlet port 421 such as the water that has run along the tilted surface 424 of the water inlet pipe 42*a* or the water that has splashed from the water inlet port 421 flows into the water receiver 8. In short, according to this variation, the drain may discharge the water that has run along the tilted surface 424 into the bowl 23.

The drained water receiver 9 may receive the water running out through the overflow opening 811. In this variation, the drained water receiver 9 is greater in dimensions than the water receiver 8 in a plan view. The outer peripheral edges of the drained water receiver 9 are standup edges, which may prevent the water received at the drained water receiver 9 from running out. In this variation, the water received at the drained water receiver 9 is channeled through the drain into the bowl 23. According to the present disclosure, however, the water received at the drained water receiver 9 does not have to be channeled into the bowl 23 but may also be channeled toward the drain trap, the drainpipe, or the floor surface, for example.

(2.2) Second Variation of Backflow Check Structure

Figure 7:
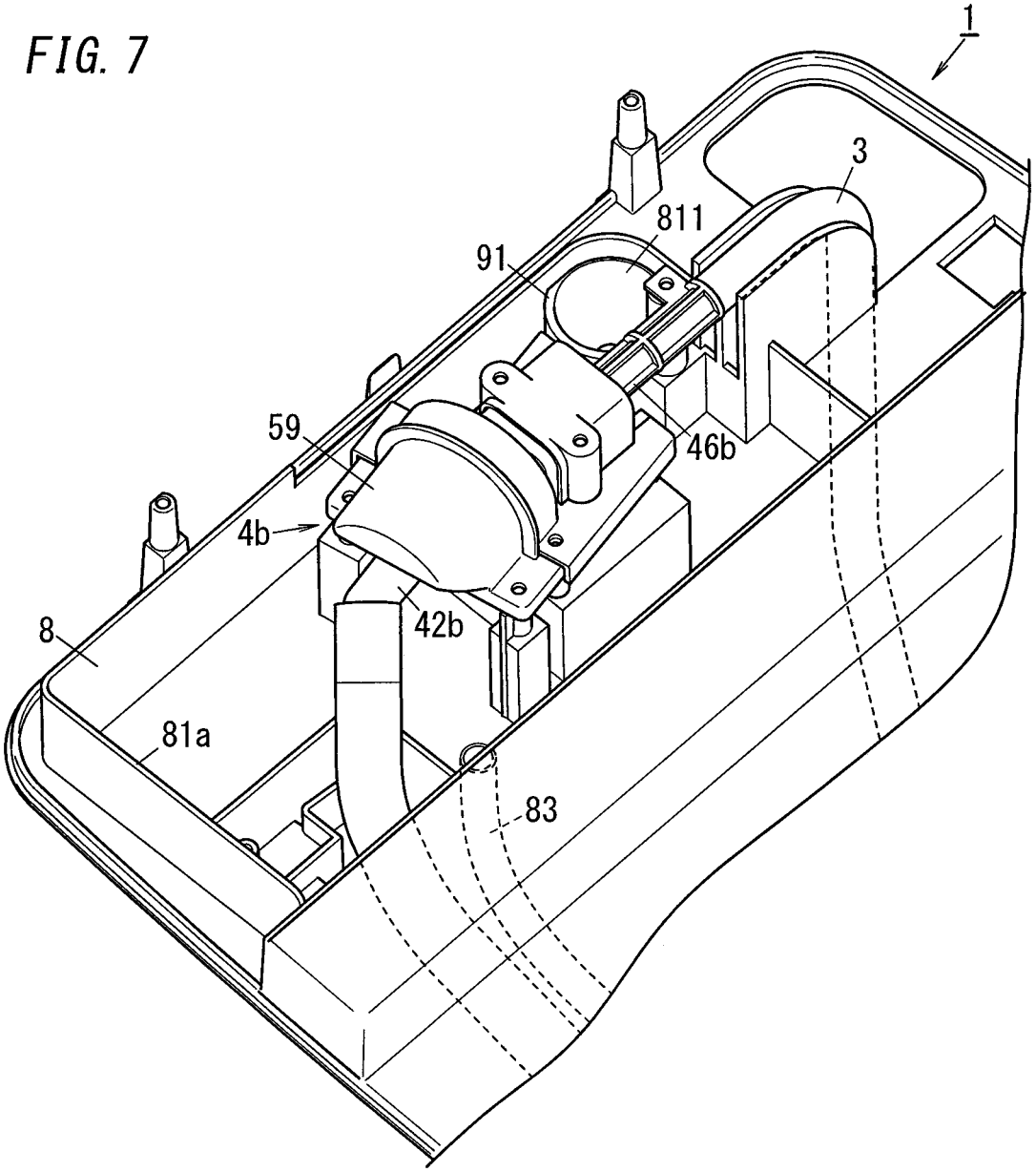
FIG. 7 is a perspective view of a backflow check structure and its surrounding portions according to a second variation.
Figure 8:
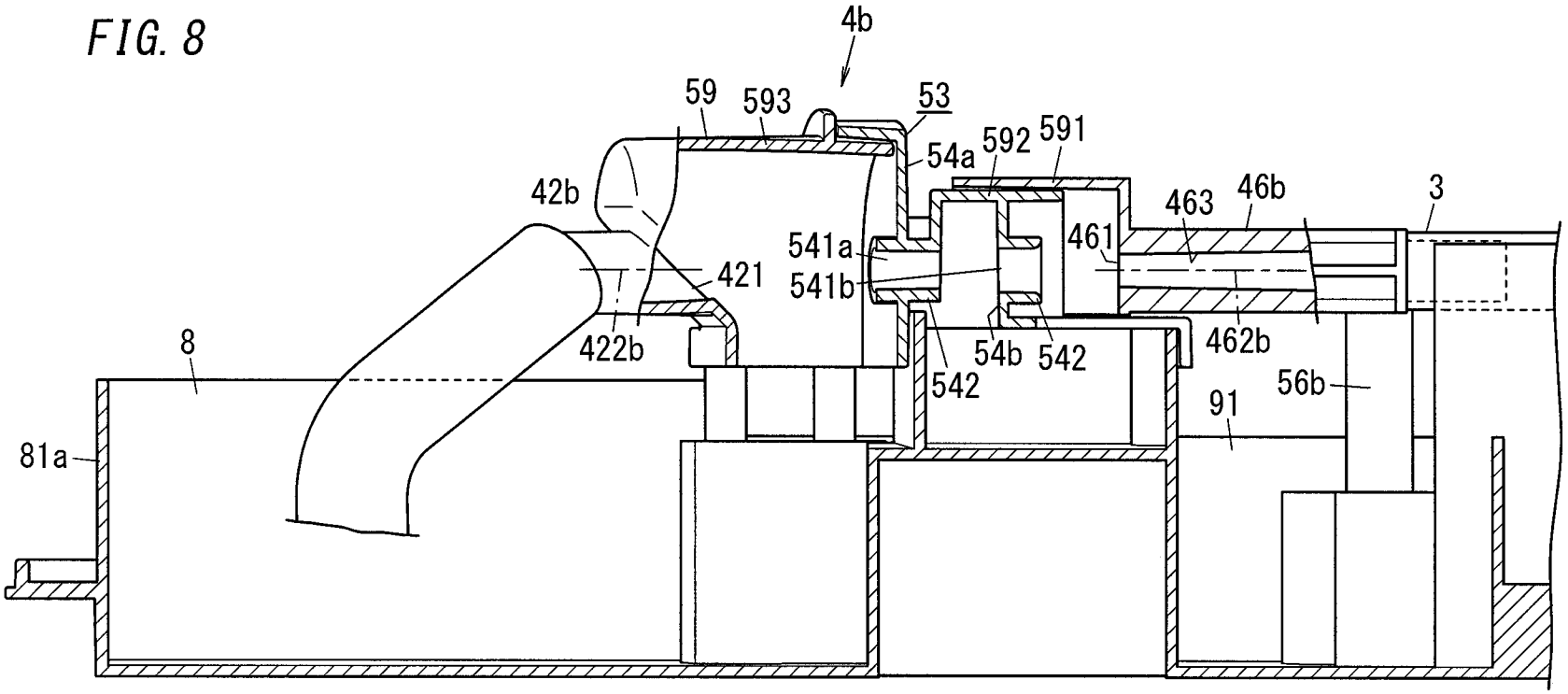
FIG. 8 is a cross-sectional view of the backflow check structure and its surrounding portions taken along a vertical plane.

A second variation of the backflow check structure 4*b* is illustrated in FIGS. 7 and 8. In the following description, any constituent element of this second variation, having the same function as a counterpart of the embodiment described above, will be designated by the same reference numeral as that counterpart's, and description thereof will be omitted herein. Note that the constituent elements, other than the ones to be described below, of the flush toilet 1 according to the second variation are the same as their counterparts of the flush toilet 1 according to the first embodiment described above.

A flush toilet 1 according to the second variation includes the backflow check structure 4*b* provided for the water supply path 3 and a water receiver 8 as shown in FIG. 7.

The backflow check structure 4*b* checks the backflow of the water running through the water supply path 3. The backflow check structure 4*b* is provided for the water supply path 3. The backflow check structure 4*b* reduces, even if damage is done to a part of the water supply path 3 when the level of the water run up in the bowl 23 rises so much as to immerse the water discharge portion 25 in the water that has run up, the chances of the water run up in the bowl 23 (see FIG. 1) flowing back through the water supply path 3. In this second variation, the backflow check structure 4*b* includes, as shown in FIG. 7, a water outlet pipe 46*b*, a water inlet pipe 42*b*, the splash reducing portion 53 (see FIG. 8), and a pipe supporting portion 56*b* (see FIG. 8).

The water outlet pipe 46*b* is a pipe through which the water supplied from the water supply source is channeled toward the water inlet pipe 42*b* (i.e., a pipe through which the water runs out of the backflow check structure 4*b*) as shown in FIG. 8. The water outlet pipe 46*b* is a pipe through which the water enters the backflow check structure 4*b*. The water outlet pipe 46*b* has a water outlet port 461 at the downstream end face thereof. The water outlet port 461 is an opening through which the water running through the water outlet pipe 46*b* runs out (i.e., the water supplied from the water supply source runs out toward the water inlet port 421). In this variation, the water outlet pipe 46*b* is attached to the bottom of the water receiver 8 via the pipe supporting portion 56*b*. In this variation, the center axis 462*b* of the water outlet pipe 46*b* is aligned with the horizontal plane and intersects at right angles with the vertical line (vertical plane). The inner peripheral surface 463, located at the end closer to the water outlet port 461, of the water outlet pipe 46*b* is formed in a tapered shape such that the channel cross section thereof decreases toward the water outlet port 461. This adequately increases the flow velocity of the water running out through the water outlet port 461.

The water inlet pipe 42*b* receives the water running out through the water outlet port 461 and channels the water toward the bowl 23. The water inlet pipe 42*b* has the water inlet port 421 at the upstream end face thereof. The water inlet port 421 communicates with the water discharge port 253 (see FIG. 2) through which the water is discharged into the bowl 23. The center axis 422*b* of the water inlet pipe 42*b* is aligned with the horizontal plane and located on the extension of the center axis 462*b* of the water outlet pipe 46*b*. In short, in this variation, the water inlet port 421 is also located on the trajectory of the water running out through the water outlet port 461 as in the exemplary embodiment described above. The water inlet port 421 is tilted with respect to the center axis 422*b* of the water inlet pipe 42*b*. The surface surrounding the opening of the water inlet port 421 is tilted with respect to the horizontal plane such that in the direction aligned with the trajectory of the water, the surface surrounding the opening of the water inlet port 421 is sloped downward toward the water outlet port 461. This allows, even if the trajectory of the water running out through the water outlet port 461 draws a parabola, the water to be received effectively at the water inlet port 421.

The splash reducing portion 53 reduces, when the water running out through the water outlet port 461 is going to enter the water inlet port 421, the chances of splashed water reaching the water outlet port 461. In this variation, the splash reducing portion 53 is arranged between the water outlet port 461 and the water inlet port 421. Also, in this variation, the splash reducing portion 53 includes a first water shutoff plate 54*a* and a second water shutoff plate 54*b*.

The first water shutoff plate 54*a* is a plate facing the water inlet port 421 to receive the water splashed from the water inlet port 421. The first water shutoff plate 54*a* is aligned with the vertical plane and intersects (e.g., at right angles in this variation) with the center axes of the water inlet pipe 42*b* and the water outlet pipe 46*b*. In this variation, the surface surrounding the opening of the water inlet port 421 is tilted with respect to the first water shutoff plate 54*a*. The first water shutoff plate 54*a* has a first water passage port 541*a* (water passage port 541). The first water passage port 541*a* runs through the first water shutoff plate 54*a*. In this variation, the diameter of the first water passage port 541*a* is equal to or greater than the diameter of the water outlet port 461 and equal to or less than the diameter of the water inlet port 421.

The second water shutoff plate 54*b* is a plate facing the water outlet port 461 and the first water shutoff plate 54*a*.

The second water shutoff plate 54*b* is a plate for receiving the water that has run out through the water outlet port 461 and plashed back and splashed from the first water shutoff plate 54*a* and the water that has plashed back from the water inlet port 421 to pass through the first water passage port 541*a* of the first water shutoff plate 54*a*. The second water shutoff plate 54*b* is aligned with the vertical plane and intersects (e.g., at right angles in this variation) with the center axis of the water inlet pipe 42*b* and the center axis 462*b* of the water outlet pipe 46*b*. That is to say, in this variation, the second water shutoff plate 54*b* is parallel to the first water shutoff plate 54*a*. The second water shutoff plate 54*b* has a second water passage port 541*b* (water passage port 541). The second water passage port 541*b* runs through the second water shutoff plate 54*b*. In this variation, the diameter of the second water passage port 541*b* is equal to or greater than the diameter of the water outlet port 461 and equal to or less than the diameter of the water inlet port 421. Even though the diameter of the second water passage port 541*b* is equal to the diameter of the first water passage port 541*a* according to this variation, the diameter of the second water passage port 541*b* may also be smaller or larger than the diameter of the first water passage port 541*a*.

The water passage ports 541 (including the first water passage port 541*a* and the second water passage port 541*b*) are surrounded with a peripheral wall 542. The peripheral wall 542 protrudes from at least a part of the circumference of the water passage ports 541 toward at least one of the water outlet port 461 or the water inlet port 421 in the direction aligned with the trajectory of the water. In this variation, the peripheral wall 542 for the first water passage port 541*a* protrudes from the entire circumference of the first water passage port 541*a* toward both the water outlet port 461 and the water inlet port 421 in the direction aligned with the trajectory of the water. Meanwhile, the peripheral wall 542 for the second water passage port 541*b* protrudes from the entire circumference of the second water passage port 541*b* toward the water outlet port 461 in the direction aligned with the trajectory of the water.

However, this is only an example and should not be construed as limiting. Alternatively, the peripheral wall for the first water passage port 541*a* may also protrude from the entire circumference of the first water passage port 541*a* toward only the water inlet port 421 in the direction aligned with the trajectory of the water or only the water outlet port 461 in the direction aligned with the trajectory of the water. Meanwhile, the peripheral wall 542 for the second water passage port 541*b* may protrude from the entire circumference of the second water passage port 541*b* toward the water inlet port 421 in the direction aligned with the trajectory of the water or both the water outlet port 461 and the water inlet port 421 in the direction aligned with the trajectory of the water. Optionally, the peripheral wall 542 may be formed on only a part of the circumference of the water passage ports 541 (including the first water passage port 541*a* and the second water passage port 541*b*).

With the peripheral wall 542 provided around the surface, facing toward the water inlet port 421, of the first water passage port 541*a*, even if the water that has run out through the water outlet port 461 plashes back and splashes from around the water inlet port 421 when entering the water inlet port 421 to spread along a cover wall 59 and the first water shutoff plate 54*a*, the water will collide against the peripheral wall 542 to fall down. In addition, even if the water runs along the first water shutoff plate 54*a*, the peripheral wall 542 prevents the water from entering the first water passage port 541. This further reduces the chances of the water that has plashed back from around the water inlet port 421 passing through the first water passage port 541*a* to flow back toward the water outlet port 461.

The backflow check structure 4*b* has the cover wall 59. The cover wall 59 reduces the chances of the water running out through the water outlet port 461 bouncing back from the water inlet port 421 and the splash reducing portion 53 to splash toward the outside. As used herein, the "outside" refers to the outside of the backflow check structure 4*b* and may be inside of the outer parts 21 of the toilet body 2. The cover wall 59 includes a first cover wall 591, a second cover wall 592, and a third cover wall 593.

The first cover wall 591 connects the tip of the water outlet port 461 to the second water shutoff plate 54*b*. The second cover wall 592 connects the second water shutoff plate 54*b* to the tip of the peripheral wall 542 for the first water passage port 541*a*. The third cover wall 593 connects the first water shutoff plate 54*a* to the end of the water inlet pipe 42*b*.

The water that has plashed back from the cover wall 59 or the splash reducing portion 53 is received at the water receiver 8. At least one drain is connected to the water receiver 8. The drain is formed by connecting a pipe such as a tube to a drainage fitting 83 connected to the water receiver 8. The water running through the drain flows into the bowl 23 as in the first variation. Alternatively, the drain may also be connected to the drain trap 76 or the drainpipe 73, for example. Still alternatively, the water running through the drain may be drained directly onto the floor surface. The water receiver 8 has a peripheral wall 81*a*. As shown in FIG. 7, the backflow check structure 4*b* is arranged inside the peripheral wall 81*a* in a plan view.

The flush toilet 1 includes an overflow portion 91, which is provided inside the water receiver 8 in a plan view. The overflow portion 91 has an overflow opening 811. The overflow opening 811 is provided at a level slightly higher than the bottom of the water receiver 8 so as to drain the water that has run up in the water receiver 8 when the drainage capacity required is not satisfied by only the drain provided for the water receiver 8. In this variation, the overflow portion 91 is formed to have a cylindrical shape and the opening at the top of the overflow portion 91 defines the overflow opening 811.

The water that has entered the overflow opening 811 is discharged toward the floor surface. However, the water that has entered the overflow opening 811 does not have to be discharged toward the floor surface but may also be channeled toward the bowl 23, the drain trap 76, or the drainpipe 73, for example.

(2.3) Other Variations

Next, other variations of the exemplary embodiment described above will be enumerated one after another. Note that the variations to be described below may be adopted in combination as appropriate.

In the exemplary embodiment and variations described above, the respective surfaces surrounding the respective openings of the water inlet port 421 and the water outlet port 461 are parallel to each other and have their respective centers aligned with each other. However, this is only an example and should not be construed as limiting. Alternatively, according to the present disclosure, when the water running out through the water outlet port 461 draws a parabola, for example, the water inlet port 421 may be located at any point on the parabola.

Furthermore, in the exemplary embodiment and variations described above, the center axis 462 of the water outlet pipe 46 and the center axis 422 of the water inlet pipe 42 are either perpendicular to, or tilted with respect to, the vertical line. However, their center axes 462 and 422 may be parallel to the vertical line. Also, in the exemplary embodiment and variations described above, the respective surfaces surrounding the respective openings of the water inlet port 421 and the water outlet port 461 are either parallel to, or tilted with respect to, the vertical line. According to the present disclosure, however, their surfaces may also intersect, at right angles, with the vertical line. In that case, even though the water splashed from the water reservoir 41 will enter the water inlet port 421 easily, the water may be introduced into the water inlet port 421 while curbing, as much as possible, the decline in the rush of the water running out through the water outlet port 461.

Furthermore, the flush toilet 1 according to the embodiment described above is designed to be installed on the floor 75. According to the present disclosure, however, the flush toilet 1 may also be a so-called "floating (or wall hung) toilet," which is fixed to the rear wall 74 with a gap left between itself and the floor 75. Still alternatively, the flush toilet 1 may also be a portable floor toilet, which is just put on the floor 75 without being fixed to the floor 75.

The flush toilet 1 may or may not include private parts washing devices. Furthermore, the flush toilet 1 according to the exemplary embodiment described above is provided such that the water inlet port 421 is continuous with the bottom wall 45 of the water reservoir 41. However, this is only an example and should not be construed as limiting. Alternatively, the flush toilet 1 may also be provided such that the water inlet port 421 (water inlet pipe 42) protrudes from the bottom wall 45 toward the water reservoir 41. This will reduce the suction of the air along the bottom wall 45 into the water inlet pipe 42, thus supplying water with more stability.

In the variations described above, the water running out through the overflow opening 811 is received at the drained water receiver 9. According to the present disclosure, however, the drained water receiver 9 may be omitted. In that case, the water running out through the overflow opening 811 may be channeled along the drain, for example, toward the drain trap, the drainpipe, or the floor surface.

Furthermore, in the variations described above, a single drain is provided for the water receiver 8. According to the present disclosure, however, a plurality of drains may be provided for the water receiver 8. In short, at least one drain needs to be provided.

Furthermore, in the variations described above, the splash reducing portion 53 reduces the splash of the water from the water inlet port 421 using the water shutoff plate 54 in a plate shape. According to the present disclosure, however, the water shutoff plate 54 does not have to be used but a piece of cloth or a film, for example, may also be used. Furthermore, in the variations described above, the splash reducing portion 53 includes one or two water shutoff plates 54. Alternatively, the splash reducing portion 53 may also include three or more water shutoff plates 54. Piling a plurality of water shutoff plates 54 one upon another along the flow path further reduces the chances of the water splashed from the water inlet port 421 reaching the water outlet port 461, which is beneficial.

Furthermore, in the variations described above, the water that has run along the tilted surface 424 is received at the water receiver 8 and then discharged through the drain. According to the present disclosure, however, the flush toilet 1 may also be configured to channel the water that has run along the tilted surface 424 directly into the drain.

(3) Aspects

A flush toilet (1) according to a first aspect includes: a bowl (23); at least one water discharge port (253) to discharge water into the bowl (23); a water supply path (3) to supply the water from a water supply source to the water discharge port (253) therethrough; and a backflow check structure (4, 4*a*, 4*b*) provided for the water supply path (3). The backflow check structure (4, 4*a*, 4*b*) checks a backflow of the water running through the water supply path (3). The backflow check structure (4, 4*a*, 4*b*) has: a water inlet port (421) exposed to the air and directly communicating with the water discharge port (253); and a water outlet port (461) to channel the water supplied from the water supply source toward the water inlet port (421). The water inlet port (421) is arranged on a trajectory of the water running out through the water outlet port (461). The water that has passed through the water inlet port (421) is channeled directly toward the water discharge port (253).

This aspect checks the backflow of the water running through the water supply path (3) because the water inlet port (421) is exposed to the air. In addition, the water running out through the water outlet port (461) is channeled directly into the water inlet port (421), thus applying water pressure to the water discharged through the water discharge port (253). The backflow check structure (4, 4*a*, 4*b*) has no driving mechanism such as a movable valve body, thus reducing the chances of causing failures.

In a flush toilet (1) according to a second aspect, which may be implemented in conjunction with the first aspect, the water supply path (3) has an expanded portion (471) between the water inlet port (421) and the water discharge port (253), and the expanded portion (471) has a larger channel cross section (by a predetermined dimension) than a portion, located upstream of the expanded portion (471), of the water supply path (3).

This aspect allows, even if a backflow is caused due to the water stagnating downstream of the expanded portion (471) along the water supply path (3) to build up the water pressure, the backflow to be still checked by the expanded portion (471). This reduces the splash of the water from the water inlet port (421).

In a flush toilet (1) according to a third aspect, which may be implemented in conjunction with the first or second aspect, the backflow check structure (4*a*, 4*b*) includes, between the water outlet port (461) and the water inlet port (421), at least one splash reducing portion (53) having a water passage port (541, 541*a*, 541*b*) to pass the water running out through the water outlet port (461).

This aspect allows, even if the water splashes from the water inlet port (421), the splash reducing portion (53) to reduce the chances of the splashed water reaching the water outlet port (461).

In a flush toilet (1) according to a fourth aspect, which may be implemented in conjunction with the third aspect, the water passage port (541, 541*a*, 541*b*) is formed to have a diameter that is equal to or greater than the water outlet port's (461) diameter and equal to or less than the water inlet port's (421) diameter.

According to this aspect, the water passage port (541, 541*a*, 541*b*) is formed to have a diameter equal to or greater than the diameter of the water outlet port (461), thus allowing the water running out through the water outlet port (461) to pass through the water passage port (541, 541*a*, 541*b*) easily. In addition, the water passage port (541, 541*a*, 541*b*) is formed to have a diameter equal to or smaller than the diameter of the water inlet port (421), thus reducing the chances of the water splashing from the water inlet port (421) entering the water passage port (541).

In a flush toilet (1) according to a fifth aspect, which may be implemented in conjunction with any one of the first to fourth aspects, the water supply path (3) includes a diameter decreasing portion (423) having its diameter decreasing from the water inlet port (421) toward a downstream end of the water supply path (3).

This aspect facilitates a tapered splash of the water from the water inlet port (421), thus reducing the chances of the splashed water reaching the water outlet port (461).

A flush toilet (1) according to a sixth aspect, which may be implemented in conjunction with any one of the first to fifth aspects, further has a tilted surface (424) formed around the water inlet port (421) and tilted with respect to a horizontal plane.

This aspect reduces, even if part of the water running out through the water outlet port (461) forms a pool around the water inlet port (421), the chances of the pool remaining around the water inlet port (421). This reduces the splash of the water even when the water running out through the water outlet port (461) agitates the pool of water formed around the water inlet port (421).

A flush toilet (1) according to a seventh aspect, which may be implemented in conjunction with any one of the first to sixth aspects, further includes a water receiver (8) to receive the water. At least part of the water receiver (8) is located below the water inlet port (421).

This aspect reduces the chances of the water that has failed to enter the water inlet port (421) overflowing to unintentional areas.

In a flush toilet (1) according to an eighth aspect, which may be implemented in conjunction with the seventh aspect, the water receiver (8) has an overflow opening (811). A lower end of the overflow opening (811) is located below a lower end (811*a*) of the water inlet port (421).

This aspect reduces, even if the water has run up in the water receiver (8), the chances of the water that has run up entering the water inlet port (421).

A flush toilet (1) according to a ninth aspect, which may be implemented in conjunction with the eighth aspect, further includes a drained water receiver (9) to receive the water running out through the overflow opening (811).

This aspect reduces the chances of the water running out through the overflow opening (811) overflowing to unintentional areas.

A flush toilet (1) according to a tenth aspect, which may be implemented in conjunction with any one of the seventh to ninth aspects, further includes at least one drain to discharge, into the bowl (23), the water that has run up in the water receiver (8).

This aspect allows the water that has failed to enter the water inlet port (421) to be channeled into the bowl (23) through a path different from the water supply path (3), which is beneficial from a hygienic point of view.

A flush toilet (1) according to an eleventh aspect, which may be implemented in conjunction with the third or fourth aspect, further includes a peripheral wall (542) protruding from at least a part of a surrounding portion, located around the water passage port (541, 541*a*, 541*b*), of the splash reducing portion (53) toward at least one of the water outlet port (461) or the water inlet port (421) in a direction aligned with the trajectory of the water.

This aspect reduces the chances of the water that has plashed back from around the water inlet port 421 passing through the first water passage port 541*a* to flow back toward the water outlet port 461, among other things.

In a flush toilet (1) according to a twelfth aspect, which may be implemented in conjunction with any one of the first to eleventh aspects, a center axis (462, 462*a*) of a water outlet pipe (46, 46*a*, 46*b*) having the water outlet port (461) is tilted with respect to a vertical line.

This aspect reduces, even if the water that has flowed backward from the water inlet port (421) has splashed, the chances of the splashed water entering the water outlet port (461).

In a flush toilet (1) according to a thirteenth aspect, which may be implemented in conjunction with any one of the first to twelfth aspects, the diameter of the water outlet port (461) is equal to or less than the diameter of the water inlet port (421).

This aspect allows the water running out through the water outlet port (461) to enter the water inlet port (421) effectively.

In a flush toilet (1) according to a fourteenth aspect, which may be implemented in conjunction with any one of the first to thirteenth aspects, a center axis (422) of a water inlet pipe (42, 42*a*, 42*b*) having the water inlet port (421) is either tilted or perpendicular to a vertical line.

This aspect allows the water running out through the water outlet port (461) to enter the water inlet port (421) and then flow smoothly through pipes (e.g., the water inlet pipe (42) and the connection pipe (47) in the embodiment described above) communicating with the water inlet port (421). Thus, this aspect reduces the pressure loss to be caused before the water reaches the water discharge port (253).

A flush toilet (1) according to a fifteenth aspect, which may be implemented in conjunction with any one of the first to fifth and eleventh to fourteenth aspects, further includes a water reservoir (41) having an air opening (43) which is exposed to the air. The flush toilet (1) further includes a splash reducing jacket (48) configured to receive the water that has splashed from inside of the water reservoir (41) toward the air opening (43) and to let the received water channel toward the water reservoir (41).

This aspect allows, even if the water running out through the water outlet port (461) plashes back from the inner surface of the water reservoir (41) and splashes toward the air opening (43), the splashed water to be received at the splash reducing jacket (48), thus reducing the chances of the water leaking.

A flush toilet (1) according to a sixteenth aspect, which may be implemented in conjunction with any one of the first to fifth and eleventh to fifteenth aspects, further includes a water reservoir (41) having an air opening (43) which is exposed to the air. The water reservoir (41) has a water guide surface (451) sloping down toward the water inlet port (421).

This aspect allows the water that has run out through the water outlet port (461) but failed to enter the water inlet port (421) to be channeled along the water guide surface (451) toward the water inlet port (421), thus reducing the chances of the water stagnating.

A flush toilet (1) according to a seventeenth aspect, which may be implemented in conjunction with any one of the first to fifth and eleventh to sixteenth aspects, further includes a connecting member (6) communicating with the water supply path (3) and connected to the water supply source. The flush toilet (1) is configured such that the water that has passed through the connecting member (6) runs out through the water supply path (3) and then is directly channeled through the water outlet port (461).

This aspect allows the water to be supplied from the water discharge port (253) toward the bowl (23) by taking advantage of the pressure of the water in the water supply source, thus enabling the water to rush into the bowl (23).

The constituent elements according to the second to seventeenth aspects are not essential constituent elements for the flush toilet (1) but may be omitted as appropriate.

REFERENCE SIGNS LIST

1 Flush Toilet
23 Bowl
253 Water Discharge Port
3 Water Supply Path
4, 4*a*, 4*b* Backflow Check Structure
421 Water Inlet Port
423 Diameter Decreasing Portion
424 Tilted Surface
46, 46*a*, 46*b* Water Outlet Pipe
461 Water Outlet Port
471 Expanded Portion
53 Splash Reducing Portion
541, 541*a*, 541*b* Water Passage Port
542 Peripheral Wall
71 Water Supply Pipe (Water Supply Source)
8 Water Receiver
811 Overflow Opening
811*a* Lower End
9 Drained Water Receiver

The invention claimed is:

1. A flush toilet comprising:

a bowl configured to receive excreta;

at least one water discharge port configured to discharge water into the bowl;

a water supply path configured to supply the water from a water supply source to the water discharge port therethrough; and a backflow check structure provided for the water supply path and configured to check a backflow of the water running through the water supply path, the backflow check structure having:

a water inlet port exposed to the air and directly communicating with the water discharge port; and a water outlet port configured to channel the water supplied from the water supply source toward the water inlet port, the water inlet port being arranged on a trajectory of the water running out through the water outlet port, the water that has passed through the water inlet port being channeled directly toward the water discharge port, a center axis of a water outlet pipe having the water outlet port and a center axis of a water inlet pipe having the water inlet port being aligned with a horizontal plane, and the backflow check structure including, between the water outlet port and the water inlet port, at least one splash reducing portion having a water passage port configured to pass the water running out through the water outlet port.

2. The flush toilet of claim 1, wherein the water passage port is formed to have a diameter that is equal to or greater than the water outlet port's diameter and equal to or less than the water inlet port's diameter.

3. The flush toilet of claim 2, further comprising a peripheral wall protruding from at least a part of a surrounding portion, located around the water passage port, of the splash reducing portion toward at least one of the water outlet port or the water inlet port in a direction aligned with the trajectory.

4. The flush toilet of claim 1, further comprising a water receiver configured to receive the water, at least a part of the water receiver being located below the water inlet port.

5. The flush toilet of claim 4, wherein the water receiver has an overflow opening, and a lower end of the overflow opening is located below a lower end of the water inlet port.

6. The flush toilet of claim 5, further comprising a drained water receiver configured to receive the water running out through the overflow opening.

7. The flush toilet of claim 4, further comprising at least one drain configured to drain, into the bowl, the water that has run up in the water receiver.

8. The flush toilet of claim 5, further comprising at least one drain configured to drain, into the bowl, the water that has run up in the water receiver.

9. The flush toilet of claim 1, further comprising a peripheral wall protruding from at least a part of a surrounding portion, located around the water passage port, of the splash reducing portion toward at least one of the water outlet port or the water inlet port in a direction aligned with the trajectory.

10. The flush toilet of claim 1, wherein a surface surrounding the opening of the water inlet port is tilted with respect to the horizontal plane such that the surface surrounding the opening of the water inlet port is sloped downward toward the water outlet port.

* * * * *